US009943197B2

(12) United States Patent
Shabat

(10) Patent No.: US 9,943,197 B2
(45) Date of Patent: Apr. 17, 2018

(54) TOILET MAINTENANCE DEVICES AND SYSTEM

(71) Applicant: Reuven Shabat, Sherman Oaks, CA (US)

(72) Inventor: Reuven Shabat, Sherman Oaks, CA (US)

( * ) Notice: Subject to any disclaimer, the term of this patent is extended or adjusted under 35 U.S.C. 154(b) by 0 days.

(21) Appl. No.: 15/482,348

(22) Filed: Apr. 7, 2017

(65) Prior Publication Data

US 2018/0042433 A1 Feb. 15, 2018

Related U.S. Application Data

(62) Division of application No. 15/423,202, filed on Feb. 2, 2017, now Pat. No. 9,848,743.

(60) Provisional application No. 62/374,728, filed on Aug. 12, 2016.

(51) Int. Cl.

| | |
|---|---|
| ***A47K 11/10*** | (2006.01) |
| ***A47K 17/00*** | (2006.01) |
| ***A46B 9/02*** | (2006.01) |
| ***A46B 15/00*** | (2006.01) |

(52) U.S. Cl.

CPC ..... *A47K 11/10* (2013.01); *A46B 9/025* (2013.01); *A46B 15/0095* (2013.01); *A47K 17/00* (2013.01)

(58) Field of Classification Search

USPC ..... 15/105, 106, 160; 4/255.01, 255.05, 4/255.11; 206/576

See application file for complete search history.

(56) References Cited

U.S. PATENT DOCUMENTS

| | | | | | |
|---|---|---|---|---|---|
| 3,890,984 | A * | 6/1975 | Lesetar | A45D 20/50 | 132/238 |
| 4,177,532 | A * | 12/1979 | Azuma | A46B 13/06 | 15/24 |
| 4,305,173 | A * | 12/1981 | Isao | A46B 3/16 | 15/1.52 |
| 4,956,892 | A * | 9/1990 | Fawkes | A47L 5/24 | 15/339 |
| 5,062,672 | A * | 11/1991 | Harris | B03C 1/28 | 15/104.001 |
| 5,259,406 | A * | 11/1993 | Hofmann | A46B 17/06 | 134/103.2 |
| 6,336,428 | B1 * | 1/2002 | Locke | A01K 13/002 | 119/611 |
| 7,730,576 | B1 * | 6/2010 | Snyder | A47L 5/26 | 15/344 |
| 2001/0052353 | A1 * | 12/2001 | Brumlik | A46B 11/0013 | 134/22.18 |
| 2007/0237570 | A1 * | 10/2007 | Lim | A46B 11/0017 | 401/279 |
| 2009/0172912 | A1 * | 7/2009 | Knopow | A46B 15/0002 | 15/344 |

(Continued)

*Primary Examiner* — Jacob K Ackun

(74) *Attorney, Agent, or Firm* — PatentFile, LLC; Bradley C. Fach; Steven R. Kick

(57) ABSTRACT

A toilet maintenance brush which may include an elongate handle having a guard end. A brush wand may be coupled to the guard end of the handle with the brush wand terminating with a brush head which may be used to clean a toilet bowl. A power supply may be in electrical communication with a light unit and with a fan unit having a fan blade. The fan blade may be rotatably driven by a motor and configured to circulate air onto the brush head.

7 Claims, 9 Drawing Sheets

(56) References Cited

U.S. PATENT DOCUMENTS

| | | | | |
|---|---|---|---|---|
| 2011/0173772 | A1* | 7/2011 | Papaleo | B08B 1/04 15/387 |
| 2014/0331425 | A1* | 11/2014 | Baker | A47K 11/10 15/114 |
| 2015/0258580 | A1* | 9/2015 | Doyle | B05B 11/0054 134/8 |

* cited by examiner

TOILET MAINTENANCE DEVICES AND SYSTEM

CROSS REFERENCE TO RELATED APPLICATIONS

This application is a divisional of U.S. application Ser. No. 15/423,202 filed on Feb. 2, 2017 which claims priority to and the benefit of the filing date of U.S. Provisional Application No. 62/374,728 filed on Aug. 12, 2016 entitled "Devices for Disinfecting and Drying a Toilet-Brush Within a Toilet-Bowl", which is hereby incorporated by reference in its entirety.

FIELD OF THE INVENTION

This patent specification relates to the field of devices and systems configured to facilitate the maintenance of toilets and toilet areas. More specifically, this patent specification relates to devices and systems configured to provide a sanitary and organized toilet and toilet environment.

BACKGROUND

The toilet-brush is an essential tool for keeping good sanitation of a toilet-bowl. Due to the matters coming in contact with the toilet-brush, in reality, a user will not let it leave the vicinity of the toilet-bowl after use, but rather insert it into its storage-container, which is usually coupled with the brush as a set and can be found next to every household toilet. The lack of means to maintain the sanitation of the toilet-brush after use, leaving those who care with the options to immerse the brush-head into a disinfecting solution mixed with the water at the water-reservoir of the toilet-bowl, shake the brush within the interior of the toilet-bowl, tack and balance it in between the toilet-seat and the edge of the toilet-bowl for dripping and drying. When not done so, the brush is inserted into the storage-container and often will still be wet and dripping upon retrieval at next use.

A toilet-brush has a densely arranged large amount of bristles that traps large amount of water and other sediments and when stored in the storage-container with lack of air ventilation, creates environment which can promote and lead to growth of fungus, bacteria, algae, mold and other hazardous and unhealthy conditions to humans and pets. That also results in the need to often maintain the cleanliness of the storage-container, which in reality left neglected. Due to not having the proper tools for disinfecting and drying the toilet-brush in the immediate area of the toilet-bowl, in an easy and effective way, it creates an exception to the rule that otherwise is not skipped when it comes to storage of items involving wetness and in this case fecal matters as well, which may be referred to as "The toilet-brush global epidemic". The inventions described herein are dedicated to solve those conflicting problems, will change the perception on how a toilet-brush needs to be maintained and promote safe and healthy living for generations to come.

Therefore a need exists for a novel toilet maintenance devices and systems which promote safe and healthy living for generations to come. There is also a need for novel toilet maintenance devices and systems which prevent the creation of an environment which can promote and lead to growth of fungus, bacteria, algae, mold and other hazardous and unhealthy conditions to humans and pets. A further need exists, for novel toilet maintenance devices and systems which are able to position a toilet-brush after use to dry and maintain the sanitation of the toilet-brush. Finally, a need exists for novel toilet maintenance devices and systems which are able to facilitate the ability of a user to clean a toilet and to maintain an organized toilet area.

BRIEF SUMMARY OF THE INVENTION

According to one aspect consistent with the principles of the invention, an accessory holding device is provided. In some embodiments, the accessory holding device may be positioned proximate to a toilet. The device may be used to hold and position a lavatory accessory, such as a plunger, or toilet maintenance brush, such as a toilet maintenance brush described herein, relative to portions of a toilet such as the toilet bowl.

In some embodiments, the device may include a storage container configured to be positioned on the ground proximate to the toilet bowl of a toilet. A vertical support pole may be with coupled to the storage container. The vertical support pole may comprise a lower end and an upper end and preferably the lower end may be coupled to the storage container. A hanger bracket may be pivotally coupled to the upper end of the vertical support pole, and the hanger bracket may be configured to hold a lavatory accessory, such as a toilet brush, plunger, toilet cleaning wand, or any other object which may be used for toilet maintenance.

According to another aspect consistent with the principles of the invention, an auxiliary module is provided. An auxiliary module may house, couple, or include one or more electrical elements, such as a fan unit, light unit, a power supply, a port, a light switch, a charge indicator, a fan switch, and/or a processing unit. In some embodiments, an auxiliary module may be removably coupled to the hangar bracket, such as by a magnet, which may be magnetically attracted to all or a portion of the hangar bracket.

According to another aspect consistent with the principles of the invention, a toilet maintenance brush is provided. In some embodiments, the brush may include a handle having a guard end and a top end. A lid may be positioned along the handle, preferably below the top end. A brush wand may be coupled to the guard end of the handle, and the brush wand may terminate with a brush head configured to clean a toilet bowl. A power supply may be in electrical communication with a motor and the motor may rotatably drive a fan blade of a fan unit in which the fan blade is configured to circulate air onto the brush head.

According to still another aspect consistent with the principles of the invention, an improved system for toilet maintenance is provided. In some embodiments, the system may include a lavatory accessory holding device which may include a storage container configured to be positioned on the ground proximate to a toilet bowl. A vertical support pole with a lower end and an upper end may be coupled to the storage container preferably with the lower end coupled to the storage container. A hanger bracket may be pivotally coupled to the upper end of the vertical support pole which may be configured to hold a toilet-bowl brush, such as a lavatory accessory or a toilet maintenance brush. The system may also include a toilet maintenance brush which may comprise an elongate handle having a guard end and a top end with the top end terminating in a handle cap. A lid may be positioned along the handle below the top end, and a brush wand may be coupled to the guard end of the handle with the brush wand terminating with a brush head which may be used to clean a toilet bowl. A power supply may be in electrical communication with a motor and with a fan unit having a fan blade. The fan blade may be rotatably driven by the motor and configured to circulate air onto the brush head.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
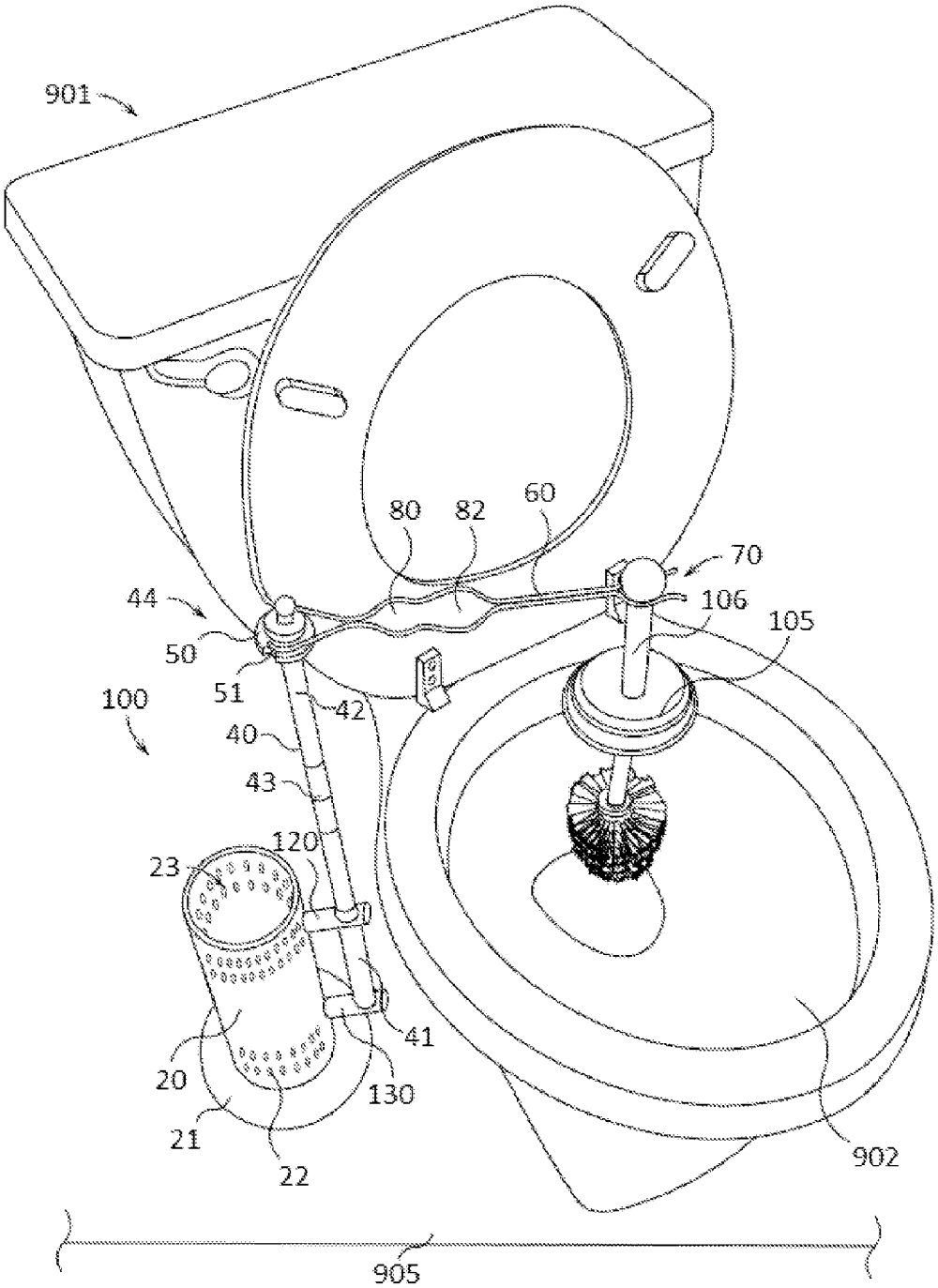
FIG. 1 depicts a perspective view of an example of an accessory holding device that is proximate to a toilet according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

New devices and systems configured to provide a sanitary and organized toilet and toilet environment are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIGS. 1-5 illustrate examples of an accessory holding device ("the device") 100 that is positioned proximate to a toilet 901 according to various embodiments. The device 100 may be used to hold and position a lavatory accessory 105 relative to portions of a toilet 901 such as the toilet bowl 902. In some embodiments, the device 100 may be positioned on the ground 905, such as an indoor floor surface, proximate to a toilet bowl 902.

In this example, the device 100 comprises a storage container 20 configured to be positioned on the ground 905 proximate to the toilet bowl 902 of a toilet 901. A vertical support pole 40 may be coupled to the storage container 20. The vertical support pole 40 may comprise a lower end 41 and an upper end 42 and preferably the lower end 41 may be coupled to the storage container 20. A hanger bracket 60 may be pivotally coupled to the upper end 42 of the vertical support pole 40, and the hanger bracket 60 may be configured to hold a lavatory accessory 105, such as a toilet brush, toilet cleaning wand, plunger, or any other object which may be used for toilet maintenance.

In some embodiments, a storage container 20 may be generally cylindrical in shape, while in other embodiments, a storage container 20 may be configured with any other shape, such as with a rectangular prism shape, a triangular prism shape, a spherical shape, or any other shape including combinations of shapes. In further embodiments, a storage container 20 may comprise a base 21 which may be relatively wider than other portions of the storage container 20.

In preferred embodiments, a storage container 20 may comprise one or more, such as a plurality of air vents 22 which may be configured in any size and shape and which may allow air to pass through the storage container 20 and into the cavity 23 of the storage container 20. The cavity 23 may be shaped to allow a portion of a lavatory accessory 105 to be received within the storage container 20. For example, a cavity 23 may be shaped to receive the brush bristles and other portions of a toilet brush type lavatory accessory 105 so that the brush bristles and other portions of the toilet brush may be hidden from view when received within the cavity 23.

A hanger bracket 60 may be configured to hold a lavatory accessory 105 and to allow the lavatory accessory 105 to be positioned relative to the storage container 20 and therefore relative to a toilet 901 that the device 100 is positioned proximate to. A hanger bracket 60 may be made in various shapes, sizes, and materials such as metal, metal alloys, plastics, wood, and the like. In this example, the hanger bracket 60 may be formed by a length of elongated material which may be bent, formed, molded, or otherwise fabricated to form the elements of the hanger bracket 60.

Figure 2:
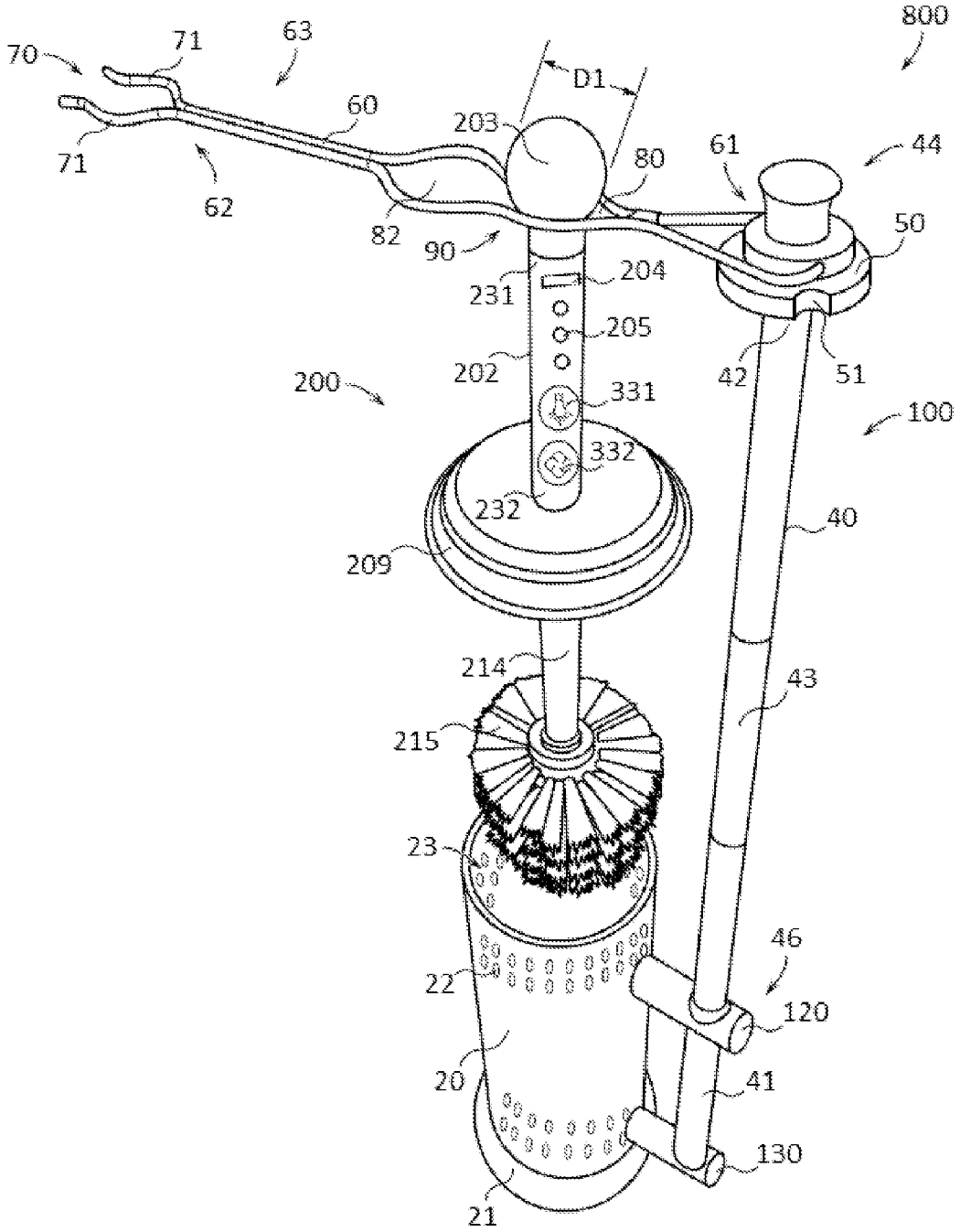
FIG. 2 illustrates a perspective view of an example of an improved system for toilet maintenance according to various embodiments described herein.
Figure 3:
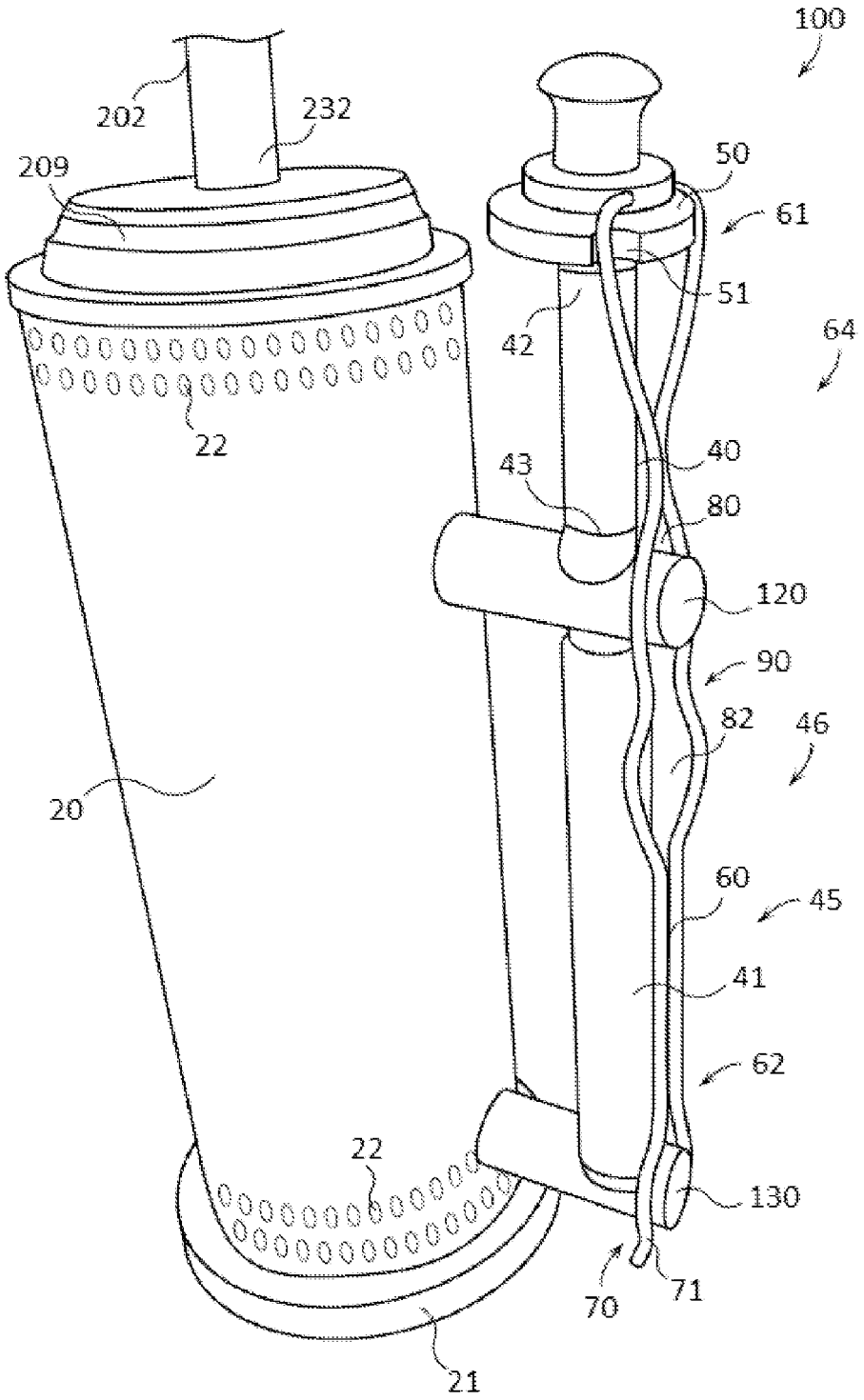
FIG. 3 shows a perspective view of an exemplary toilet brush type lavatory accessory stored within an example of a lavatory accessory holding device according to various embodiments described herein.

Turning now to FIGS. 2 and 3, an example of a lavatory accessory holding device 100 with an exemplary toilet brush type lavatory accessory according to various embodiments described herein is illustrated. In some embodiments, the vertical support pole 40 may be coupled to the storage container 20 with an upper container support member 120 and a lower container support member 130. An upper container support member 120 may couple an upper portion of the lower end 41 of the vertical support pole 40 to a relatively upper portion of the storage container 20, and a lower container support member 130 may couple a lower portion of the lower end 41 of the vertical support pole 40 to a relatively lower portion of the storage container 20. Preferably, the portion of the vertical support pole 40 that is between the upper container support member 120 and the lower container support member 130 may form a handle which may be used to transport the device 100. The upper 120 and lower 130 container support members may extend horizontally away from the storage container 20 and are adapted to secure or couple the vertical support pole 40 in a vertical position 46 proximate to the storage container 20. In alternative embodiments, the vertical support pole 40 may be coupled to the storage container 20 in a vertical position 46 with one or more fasteners, adhesives, by being integrally formed together, or other coupling method.

In some embodiments, the vertical support pole 40 may comprise a telescoping section 43 which may be positioned or disposed between the lower end 41 and the upper end 42. A telescoping section 43 may allow the upper end 42 to be moved towards and away from the lower end 41. For example, a telescoping section 43 may comprise one or more segments or sections which may be retracted into and extended from each other. The telescoping section 43 may be transitioned between a first raised position 44, in which the upper end 42 is relatively farther from the lower end 41, and a second lowered position 45, in which the upper end 42 is relatively closer to the lower end 41.

Preferably, the hanger bracket 60 may be pivotally coupled to the upper end 42 of the vertical support pole 40. The hanger bracket 60 may be pivoted between an extended position 63 (FIG. 2), in which the hanger bracket 60 may be positioned generally perpendicular to the vertical support pole 40, and a retracted position 64 (FIG. 3), in which the hanger bracket 60 may be positioned generally parallel to the vertical support pole 40.

Figure 4:
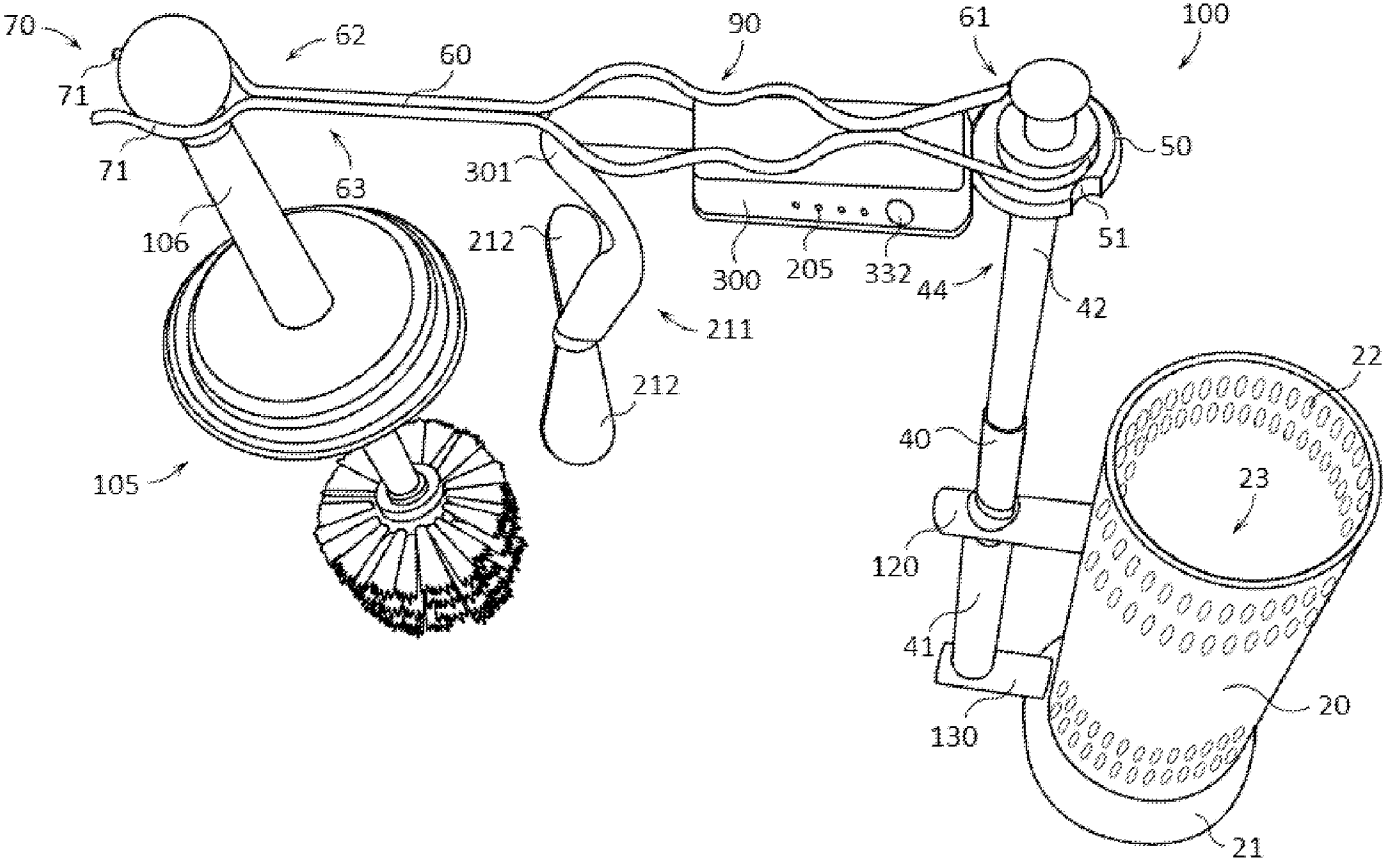
FIG. 4 depicts a perspective view of an example of a lavatory accessory holding device with an exemplary toilet brush type lavatory accessory according to various embodiments described herein.

In some embodiments, the vertical support pole 40 may comprise a support platform 50 which may be coupled to the upper end 42 of the vertical support pole 40 and which may pivotally secure a proximal end 61 of the hanger bracket 60 to the vertical support pole 40. The support platform 50 may be coupled to the hanger bracket 60 and may support the proximal end 61 of the hanger bracket 60, and therefore the hangar bracket 60, generally perpendicular to the vertical support pole 40 while the hanger bracket 60 is in the extended position 63. In further embodiments, the support platform 50 may comprise a hanger recess 51 which may be configured or shaped to receive the proximal end 61 of the hanger bracket 60 when the hanger bracket 60 is collapsed downward in a retracted position 64 parallel to the vertical support pole 40. For example, portions of the proximal end 61 may rest on or be supported by the support platform 50 as shown in FIGS. 2, 4, and 5, when the hanger bracket 60 is in the extended position 63, and once pivoted, portions of the proximal end 61 may be received in one or more indent or recess shaped hanger recesses 51 as shown in FIG. 3 when the hanger bracket 60 is in the retracted position 64.

The hanger bracket 60 may be configured to hold or secure and position a lavatory accessory 105 relative to a toilet 901. In some embodiments, the hanger bracket 60 may comprise a distal accessory holder 70 which may removably secure a lavatory accessory 105 above the toilet bowl 902. A distal accessory holder 70 may be positioned on or proximate to the distal end 62 of the hanger bracket 60 and may secure portions of a lavatory accessory 105 (FIG. 1), such as portions of the accessory handle 106 (FIG. 1). In further embodiments, the distal accessory holder 70 may comprise a set of prongs 71 which may be adapted to removably clasp a handle 106 of a lavatory accessory 105. In alternative embodiments, a distal accessory holder 70 may comprise any type of removable attachment method which may be used to removably secure a lavatory accessory 105, such as a J-hook with hanging loop type fastener, a magnetic fastener, a turn to lock connection method, or any other suitable removable attachment method.

In some embodiments, the hanger bracket 60 may comprise a proximal accessory holder 90 which may removably secure a lavatory accessory 105 in a position proximate to but not directly above the toilet bowl and is preferably positioned over the storage container 20. Generally, a proximal accessory holder 90 may be disposed relatively closer to the proximal end 61 than the distal accessory holder 70, and the distal accessory holder 70 may be disposed relatively closer to the distal end 62 than the proximal accessory holder 90. In this manner, when the hanger bracket 60 is in the extended position 63, a lavatory accessory 105 secured to the proximal accessory holder 90 may be disposed in a position proximate to but not directly above the toilet bowl 902 such as directly over the storage container 20, while a lavatory accessory 105 secured to the distal accessory holder 70 may be disposed in a position above the toilet bowl 902.

Figure 5:
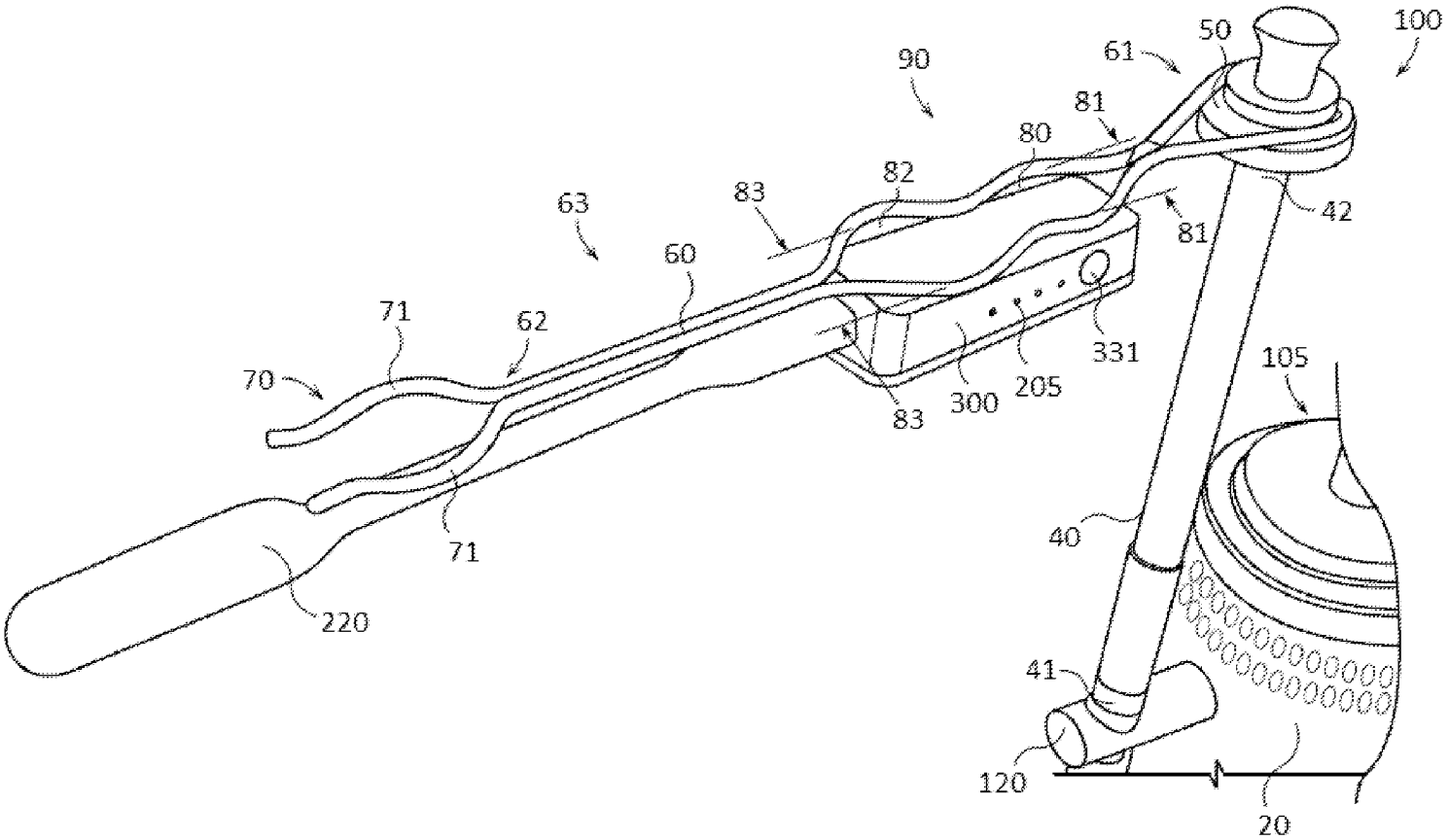
FIG. 5 illustrates a perspective view of an example of a lavatory accessory holding device and a further example of an auxiliary module according to various embodiments described herein.
Figure 6:
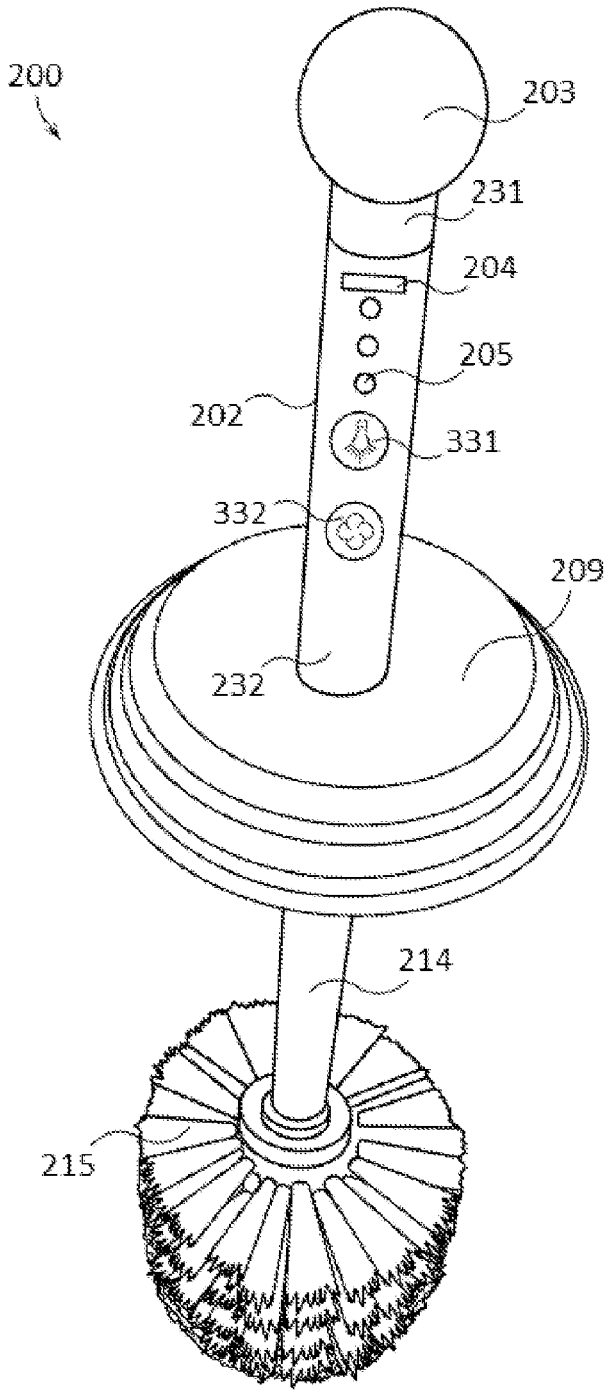
FIG. 6 shows a perspective view of an example of a toilet maintenance brush according to various embodiments described herein.

In some embodiments, a proximal accessory holder 90 may comprise a retaining opening 80 which may have a first width 81 (FIG. 5). Preferably, the first width 81 may be approximately smaller than the width of a portion of the lavatory accessory 105, such as a portion of the accessory handle 106, so that a portion of the lavatory accessory 105 may rest on or otherwise be supported by the first width 81.

In some embodiments, the hanger bracket 60 may comprise an access opening 82 adjacent to or proximate to a retaining opening 80. The access opening 82 may comprise a second width 83 which may be greater than the first width 81 of the retaining opening 80. Preferably, the second width 83 may be approximately greater than the width of a portion of the lavatory accessory 105, such as the accessory handle 106, so that a portion of the lavatory accessory 105 may be freely moved into and out of the access opening 82. In preferred embodiments, the retaining opening 80 and the access opening 82 may be in communication so that a portion of the lavatory accessory 105 may be moved between the retaining opening 80 and the access opening 82 without requiring the lavatory accessory 105 to be completely removed from the hanger bracket 60.

Figure 9:
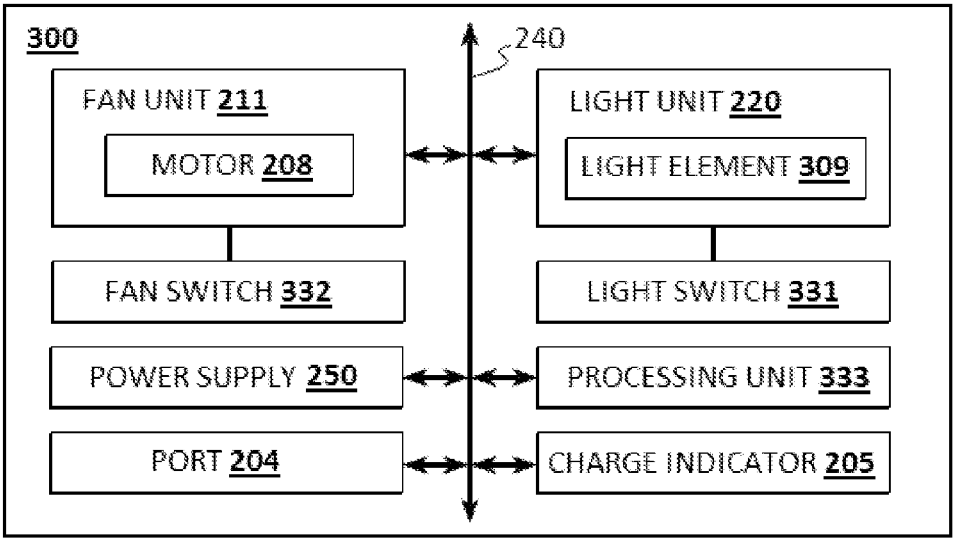
FIG. 9 shows a block diagram of some of the components of an example of an auxiliary module according to various embodiments described herein.
Figure 10:
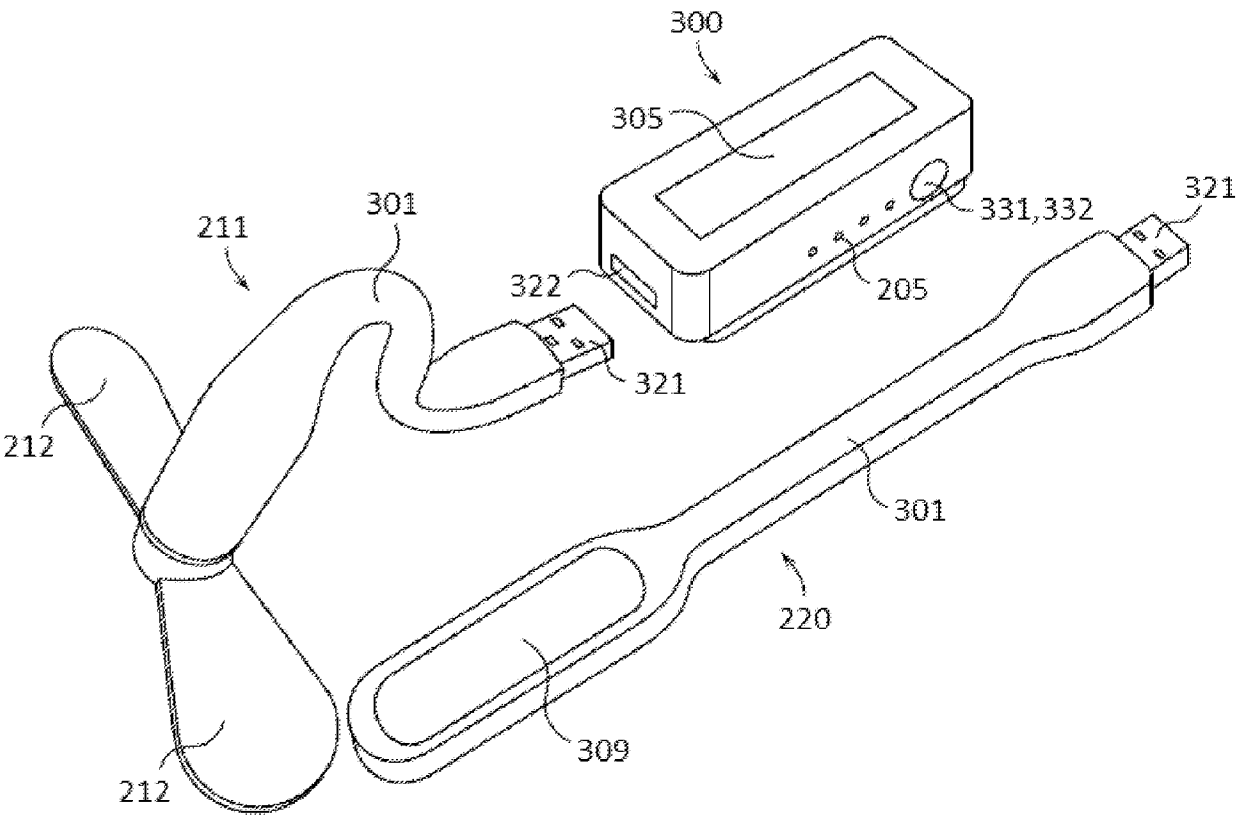
FIG. 10 depicts a perspective view of an example of an auxiliary module according to various embodiments described herein.

Referring now to FIGS. 5, 9, and 10, in some embodiments, the lavatory accessory holding device 100 may comprise an auxiliary module 300. An auxiliary module 300 may house, couple, or comprise one or more electrical elements. In some embodiments, an auxiliary module 300 may be removably coupled to the hangar bracket 60. In further embodiments, an auxiliary module 300 may comprise a magnet 305 or be coupled to a magnet 305 which may be magnetically attracted to all or a portion of the hangar bracket 60. In still further embodiments, one or more surfaces of the auxiliary module 300 may be formed by a magnet 305 or comprise a magnet 305. In alternative embodiments, an auxiliary module 300 may be removably coupled to the hangar bracket 60 with hook and loop type fasteners, snap type fasteners, or any other removable connection method.

Optionally, the auxiliary module 300 may comprise a fan unit 211 and/or a light unit 220. In further embodiments, an auxiliary module 300 may comprise a power supply 250, a port 204, a light switch 331, a charge indicator 205, a fan switch 332, and/or a processing unit 333 which may be communicatively coupled via a local interface 240. The local interface 240 can be, for example but not limited to, one or more buses, circuit boards, printed circuits, or other wired or wireless connections, as is known in the art.

A power supply 250 may provide electrical power to one or more electrical components of an auxiliary module 300 that may require electrical power. A power supply 250 may comprise a battery, such as a lithium ion battery, nickel cadmium battery, alkaline battery, or any other suitable type of battery, a fuel cell, a capacitor, a super capacitor, or any other type of energy storing and/or electricity releasing device. In further embodiments, a power supply 250 may comprise a power cord, kinetic or piezo electric battery charging device, a solar cell or photovoltaic cell, and/or inductive charging or wireless power receiver.

A charger indicator 205 may be in communication with the power supply 250 and may be configured to provide visual output which may describe the power level or amount of charge in a power supply 250. In some embodiments, a charge indicator 205 may comprise a light emitting element which may emit light of different colors to visually describe the power level or amount of charge in a power supply 250. In other embodiments, a charge indicator 205 may comprise two or more light emitting elements which may emit light of different colors and/or which may selectively illuminate to visually describe the power level or amount of charge in a power supply 250. In alternative embodiments, a charge indicator 205 may be or comprise any other style or type of device or method which may be able to provide visual (such as a numerical or graphical display), tactile (such as by a vibration motor), and/or audible (such as by a speaker) output which may describe the power level or amount of charge in a power supply 250.

A port 204 may be configured to communicate electrical power received from a power source to the power supply 250. In some embodiments, a port 204 may comprise a USB connector such as a micro-USB or mini-USB. In other embodiments, a port 204 may comprise a Type A USB plug, a Type B USB plug, a Mini-A USB plug, a Mini-B USB plug, a Micro-A USB plug, a Micro-B USB plug, a Micro-B USB 3.0 plug, a ExtMicro USB plug, a Lightning plug, a 30-pin dock connector, a Pop-Port connector, a Thunderbolt plug, a Firewire plug, a Portable Digital Media Interface (PDMI) plug, a coaxial power connector plug, a barrel connector plug, a concentric barrel connector plug, a tip connector plug, or any other plug, connector, or receptacle capable of communicating electricity to the port 204.

In some embodiments, an auxiliary module 300 may comprise a fan unit 211 which may be removably coupled to portions of the auxiliary module 300 with a male 321 and a female 322 electrical power connector, such as a USB type plug or any other suitable connector. In further embodiments, a female electrical power connector 322 may be a port 204 and/or a port 204 may be a female electrical power connector 322. The fan unit 211 may comprise a motor 208 which may rotate a fan blade 212 to circulate air in one or more directions such as to a lavatory accessory 105 proximate to the fan unit 211. Optionally, the fan unit 211 may comprise an adjustable neck 301 which may be bendable, tilt-able, movable, or otherwise positionable and which may allow the fan blades 212 and the air which they may circulate to be directed in various positions such as to circulate air to a lavatory accessory 105. For example, the fan blades 212 may be disposed at the end of an adjustable neck 301 made of a flexible rubber material with a bendable metal spine that may remain in positions in which it is bent or moved. In preferred embodiments, an auxiliary module and/or fan unit 211 may comprise a fan switch 332, such as a turnable control knob, a depressible button type switch, or any other control input, which may be used to control or modulate the speed or the ability of the fan blades to rotate.

In some embodiments, an auxiliary module 300 may comprise a light unit 220 which may be removably coupled to portions of the auxiliary module 300 with a male 321 and a female 322 electrical power communicating connection method, such as a USB type plug or any other suitable connector. The light unit 220 may comprise one or more light elements 309, such as light emitting diodes (LEDs), incandescent light bulbs, or any other light emitting element, which may emit light in one or more directions such as to a toilet 901, toilet bowl 902, and/or lavatory accessory 105 proximate to the light unit 220. Optionally, the light unit 220 may comprise an adjustable neck 301 which may be bendable or otherwise positionable which may allow the light elements 309 and the light which they emit to be directed in various positions. For example, the one or more light elements 309 may be disposed at the end of an adjustable neck 301 made of a flexible rubber material with a bendable metal spine that may remain in positions in which it is bent or moved. In preferred embodiments, an auxiliary module and/or light unit 220 may comprise a light switch 331, such as a turnable control knob, a depressible button type switch, or any other control input, which may be used to control or modulate the amount of light or the ability of the light elements 309 to produce light.

In some embodiments, an auxiliary module 300 may comprise a processing unit 333 which may be configured to control one or more electrical components such as a fan unit 211 and/or light unit 220. The processing unit 333 may be a processor hardware device for executing software instructions. The processing unit 333 can be any custom made or commercially available unit including a processor, a central processing unit (CPU), an auxiliary processor among several processors, a semiconductor-based microprocessor (in the form of a microchip or chip set), or generally any device for executing software instructions. In further embodiments, the processing unit 333 may be or provide a preset run-time circuitry to conserve energy and eliminate the need for user interaction to turn off the auxiliary module 300, fan unit 211, and/or light unit 220.

Turning now to FIGS. 2, 6-8, an example of a toilet maintenance brush ("the brush") 200 according to various embodiments is depicted. The toilet maintenance brush 200 may be used to clean objects, such as a toilet 901 and toilet bowl 902, and may be positioned and stored by a lavatory accessory holding device 100 (FIGS. 1-5).

In some embodiments, the brush 200 may comprise a handle 202 having a guard end 232 and a top end 231, the top end 231 may be a pommel shaped end, or other suitable shape forming a top distal end of the brush 200. A lid 209 may be positioned along the handle 202, preferably below the top end 231. A brush wand 214 may be coupled to the guard end 232 of the handle 202, and the brush wand 214 may terminate with a brush head 215 configured to clean a toilet bowl 902. A power supply 250 may be in electrical communication with a motor 208 and the motor 208 may rotatably drive a fan blade 212 of a fan unit 211 in which the fan blade 212 is configured to circulate air onto the brush head 215.

The handle 202 may preferably be of an elongate shape, having a length that is greater than the width, but the handle 202 may be configured in any shape and size. In some embodiments, the handle 202 may comprise a handle cap 203 coupled to the top end 231 which may be shaped larger than portions of the handle 202, such as by having a width that is greater than the width of the handle 202. In further embodiments, the width of the handle cap 203 may be greater than the first width 81 of the retaining opening 80 but less than the second width 83 of the access opening 82, thereby allowing the handle cap 203 to be inserted and removed through the access opening 82 and held in the retaining opening 80. In alternative embodiments, a handle cap 203 and/or handle 202 may comprise any other shape or fastener which may allow the brush 200 to be removably coupled to the hanger bracket 60.

A lid 209 may be positioned along the handle 202 by preferably being coupled to and below the top end 231. In preferred embodiments, a lid 209 may be generally complementary in shape to the shape of upper portions of a storage container 20 (FIGS. 1-5) so that the lid 209 may rest on or be supported by the storage container 20. In alternative embodiments, the lid 209 may be larger or smaller than portions of the storage container 20 or may be made of any other shape.

A brush wand 214 may be coupled to the guard end 232 of the handle 202. In some embodiments, a brush wand 214 may be coupled to the guard end 232 via a spacer bracket 216 which may be coupled to the lid 209, the handle 202, and/or a lid plate 221. A spacer bracket 216 may be shaped to allow the fan blades 212 of a fan unit 211 disposed in the brush 200 to freely rotate. For example, the spacer bracket 216 may comprise one or more arms 217 which may be spaced apart a distance greater than the width of the fan blades 212. The arms 217 may be coupled to the lid 209 and the lower terminus 218 may be coupled to the brush wand 214. In this manner, the spacer bracket 216 may provide a space for the fan blades 212 to rotate in an unobstructed manner below the lid 209.

In some embodiments, the brush wand 214 may comprise and terminate with one or more bristles, such as a plurality of bristles, which may form a brush head 215. The brush head 215 may function as a cleaning brush thereby allowing the brush head 215 to be configured to clean a toilet bowl 902 and other objects. In other embodiments, the brush wand 214 and/or brush head 215 may comprise any other type of material which may be used to clean an object, such as foam, sponge, terry cloth, disposable fabric pads, and washable fabric pads.

In some embodiments, the brush 200 may comprise one or more electronic components which may be housed in the handle 202, handle cap 203, lid 209, lid plate 221, and/or brush wand 214. In further embodiments, the brush 200 may comprise a fan unit 211 and/or a light unit 220. In further embodiments, a brush 200 may comprise a power supply 250, a port 204, a light switch 331, a charge indicator 205, a fan switch 332, and/or a processing unit 333 which may be communicatively coupled via a local interface 240. The local interface 240 can be, for example but not limited to, one or more buses, circuit boards, printed circuits, or other wired or wireless connections, as is known in the art.

In preferred embodiments, the handle 202 may house or comprise one or more electronic components or elements such as a power supply 250, a port 204, a charge indicator 205, a light switch 331, and/or a fan switch 332. A power supply 250 may be rechargeable or not rechargeable and may provide electrical power to one or more electrical components of an auxiliary module 300 that may require electrical power such as a fan unit 211 and/or a light unit 220. A port 204 may be configured to communicate electrical power received from a power source to the power supply 250 thereby allowing a rechargeable power supply 250 to be recharged with the power supplied to the port 204. A charge indicator 205 may be in communication with the power supply 250 and may be configured to provide output which may describe the power level or charge level of a power supply 250.

In some embodiments, a brush 200 may comprise a processing unit 333 which may be configured to control one or more electrical components such as a fan unit 211 and/or light unit 220. In further embodiments, the processing unit 333 may be or provide a preset run-time circuitry to conserve energy and eliminate the need for user interaction to turn off the fan unit 211, and/or light unit 220.

In some embodiments, the brush 200 may comprise a fan unit 211 which may be in communication with the power supply 250. Preferably, a fan unit 211 may be coupled to or below the lid 209 and/or lid plate 221. Optionally, a fan unit 211 may be coupled to a male 222 or female 223 fastener coupled to or below the lid 209 and/or lid plate 221. The fan unit 211 may comprise a motor 208 which may rotatably drive a fan blade 212 to circulate air in one or more directions such as towards a brush wand 214 and brush head 215. In preferred embodiments, the handle 202 may comprise a fan switch 332, such as a turnable control knob, a depressible button type switch, or any other control input, which may be used to control or modulate the speed or the ability of the fan blades 212 to rotate.

Figure 7:
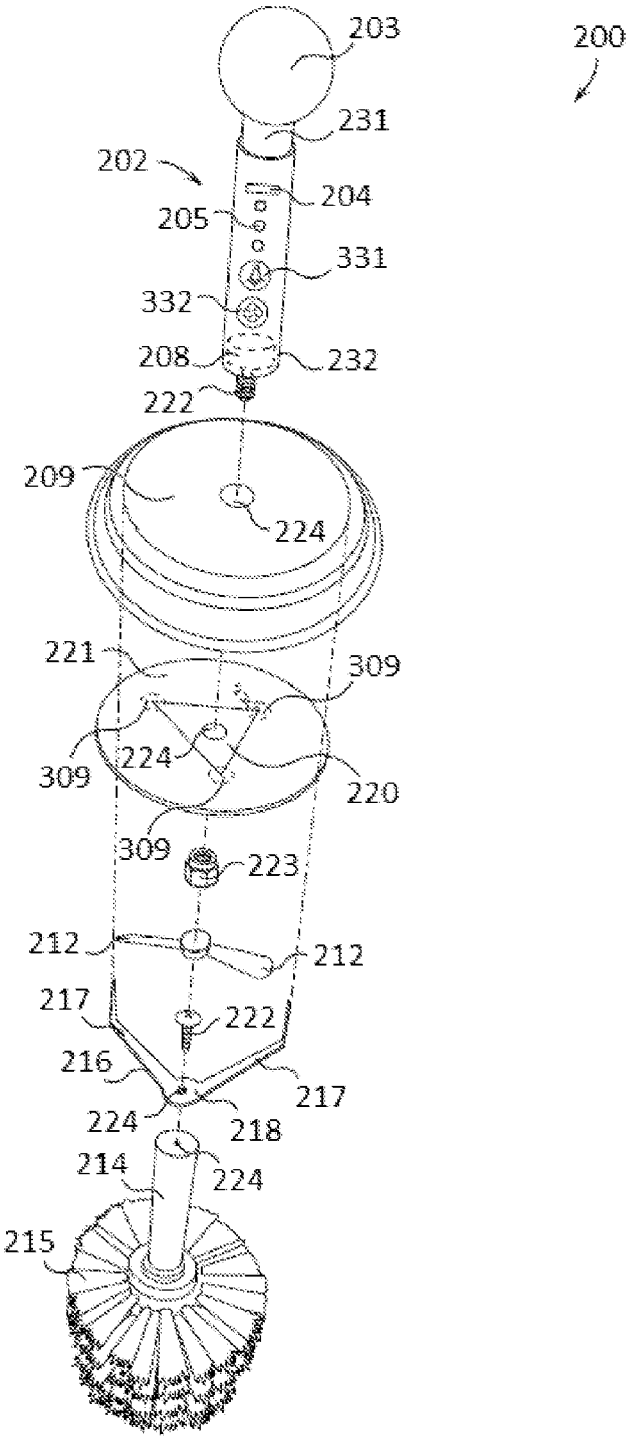
FIG. 7 depicts a perspective exploded view of an example of a toilet maintenance brush according to various embodiments described herein.
Figure 8:
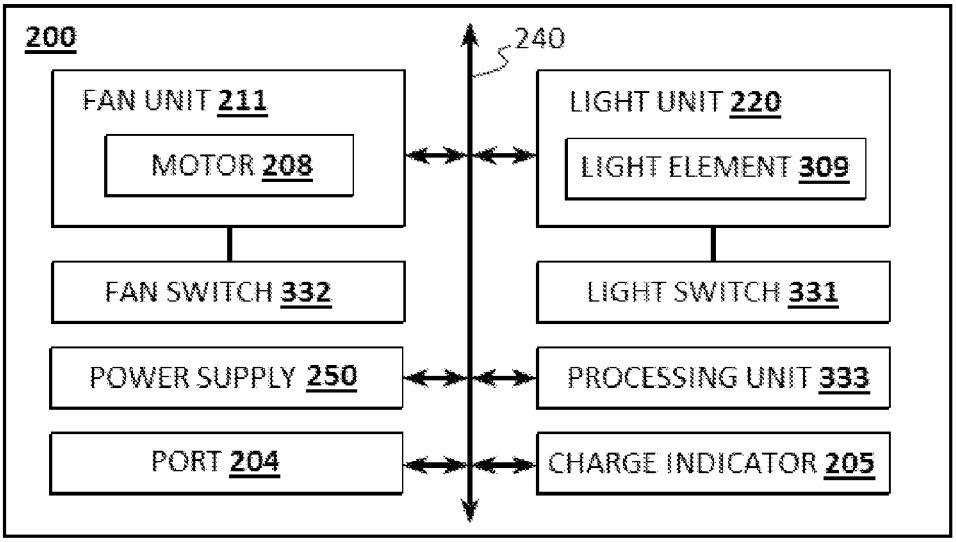
FIG. 8 illustrates a block diagram of some of the components of an example of a toilet maintenance brush according to various embodiments described herein.

In some embodiments, the brush 200 may comprise a light unit 220 which may be in communication with the power supply 250 and which may be positioned on or below the lid 209 and configured to illuminate an area proximate to the brush wand 214 and/or brush head 215. The light unit 220 may comprise one or more light elements 309, such as light emitting diodes (LEDs), incandescent light bulbs, or any other light emitting element, which may emit light in one or more directions such as in the vicinity of the toilet 901, into the toilet bowl 902, brush wand 214, and/or brush head 215 proximate to the light unit 220. Optionally, one or more light elements 309, such as a first light element 309, a second light element 309, a third light element 309, fourth light element 309, fifth light element 309, etc., may be coupled to or secured by a lid plate 221 which may be positioned below the lid 209. FIG. 7 shows an example of three light elements 309 arranged below the lid 209 and spaced approximately 120 degrees apart from each other. Preferably, a lid plate 221 may be made of a transparent or translucent material such as glass or plastic which may allow the light units 220 to be positioned between the lid plate 221 and the lid 209 while allowing light to pass through the lid plate 221 thereby allowing the lid plate 221 to secure the light elements 309 of a light unit 220. In other embodiments, one or more light units 220 may be coupled to a lid plate 221 and/or lid 209 in any other manner. In preferred embodiments, a brush 200 may comprise a light switch 331, such as a turnable control knob, a depressible button type switch, or any other control input, which may be used to control or modulate the amount of light or the ability of a light element 309 of a light unit 220 to produce light.

In some embodiments, one or more elements of the brush 200 may be coupled together with one or more male fasteners 222 and female fasteners 223 which may be inserted through one or more fastener apertures 224 formed into one or more elements of the brush 200. For example, a male fastener 222 may be embedded or otherwise coupled to the guard end 232 of the handle 202 and inserted through a fastener aperture 224 of a lid 209 a fastener aperture 224 of a lid plate 221 and/or light unit 220. A female fastener 223 may be engaged to the male fastener 222, such as with threading, thereby securing the handle 202, lid 209, and lid plate 221 together. Likewise, a male fastener 222 may be inserted through a fastener aperture 224 of a lower terminus 218 of a spacer bracket 216 to thread into brush wand 214 and couple the spacer bracket 216 and brush wand 214. In other embodiments, any other type of fastening method, such as rivets, adhesives, heat bonding, chemical bonding, integrally forming or molding, may be used to couple a handle 202, lid 209, light unit 220, lid plate 221, fan unit 211, spacer bracket 216, brush wand 214, and/or any other element of a brush 200.

The processing unit 333 may be a processor hardware device for executing software instructions. The processing unit 333 can be any custom made or commercially available unit including a processor, a central processing unit (CPU), an auxiliary processor among several processors, a semiconductor-based microprocessor (in the form of a microchip or chip set), or generally any device for executing software instructions.

Turning now to FIG. 2, a perspective view of an example of an improved system for toilet maintenance ("the system") 800 according to various embodiments is illustrated. In some embodiments, the system 800 may comprise a lavatory accessory holding device 100 which may include a storage container 20 configured to be positioned on the ground 905 proximate to a toilet bowl 902 (FIG. 1). A vertical support pole 40 with a lower end 41 and an upper end 42 may be coupled to the storage container 20 preferably with the lower end 41 coupled to the storage container 20. A hanger bracket 60 may be pivotally coupled to the upper end 42 of the vertical support pole 40 which may be configured to hold a toilet-bowl brush, such as a lavatory accessory 105 (FIG. 1) or a toilet maintenance brush 200. The system 800 may also include a toilet maintenance brush 200 which may comprise an elongate handle 202 having a guard end 232 and a top end 231 with the top end 231 terminating in a handle cap 203. A lid 209 may be positioned along the handle 202 below the top end 231, and a brush wand 214 may be coupled to the guard end 232 of the handle 202 with the brush wand 214 terminating with a brush head 215 which may be used to clean a toilet bowl 902. Also referring to FIG. 8 of a toilet maintenance brush 200, a power supply 250 may be in electrical communication with a motor 208 and with a fan unit 211 having a fan blade 212. The fan blade 212 may be rotatably driven by the motor 208 and configured to circulate air onto the brush head 215.

In some embodiments of the system 800, the hanger bracket 60 may be configured to pivot relative to the upper end 42 of the vertical support pole 40 and transition from an extended position 63 in which the hanger bracket 60 may be positioned perpendicular to the vertical support pole 40 to a retracted position 64 (FIG. 3) in which the hanger bracket 60 may be positioned parallel to the vertical support pole 40.

In some embodiments of the system 800, the vertical support pole 40 may comprise a telescoping section 43 which may be configured to transition between a first raised position 44 and a second lowered position 45 (FIG. 3). In further embodiments of the system 800, the hanger bracket comprises a distal accessory holder configured to removably secure the toilet-bowl brush above the toilet bowl 902 (FIG. 1). Optionally, the system 800 may include a distal accessory holder 70 having a set of prongs 71 adapted to removably clasp the handle cap 203 and/or other portion of a handle 202 of a toilet-bowl brush, such as a lavatory accessory 105 (FIG. 1) or a toilet maintenance brush 200.

In some embodiments of the system 800, the hanger bracket 60 may comprise a proximal accessory holder 90 having a retaining opening 80 with a first width 81 (best shown in FIG. 5) which may be shaped or configured to removably secure a toilet-bowl brush, such as a lavatory accessory 105 (FIG. 1) or a toilet maintenance brush 200, in a position proximate to but not directly above the toilet bowl 902 of the toilet 901 which the storage container 20 is positioned proximate too. In further embodiments of the system 800, the hanger bracket 60 may comprise an access opening 82 adjacent to or proximate to the retaining opening 80, and the access opening 82 may have a second width 83 (best shown in FIG. 5) greater than the first width 81 and greater than the diameter D1 or width of the handle cap 203 and/or another portion of the handle 202 so that the handle cap 203 and/or another portion of the handle 202 may pass through the access opening 82.

In still further embodiments, the system 800 may not comprise a toilet maintenance brush 200. Optionally, the system 800 may comprise any commercially available toilet-brush or the like. In still further embodiments, the system 800 may comprise a lavatory accessory holding device 100 and an auxiliary module 300 which may have a fan unit 211 and/or light unit 220.

While some materials have been provided, in other embodiments, the elements that comprise the system 800, lavatory accessory holding device 100, toilet maintenance brush 200, auxiliary module 300, and/or any other element discussed herein may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the system 800, lavatory accessory holding device 100, toilet maintenance brush 200, auxiliary module 300, and/or any other element discussed herein may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the system 800, lavatory accessory holding device 100, toilet maintenance brush 200, auxiliary module 300, and/or any other element discussed herein may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the system 800, lavatory accessory holding device 100, toilet maintenance brush 200, auxiliary module 300, and/or any other element discussed herein may be coupled by being one of connected to and integrally formed with another element of the system 800, lavatory accessory holding device 100, toilet maintenance brush 200, auxiliary module 300, and/or any other element discussed herein.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A toilet maintenance brush, the brush comprising:
- a handle having a guard end and a top end;
- a lid positioned along the handle, below the top end;
- a brush wand coupled to the guard end of the handle, the brush wand terminating with a brush head configured to clean a toilet bowl;
- a power supply in electrical communication with a motor; and
- a fan unit having a fan blade, the fan blade rotatably driven by the motor and configured to circulate air onto the brush head.

2. The brush of claim 1, further comprising a spacer bracket with a lower terminus coupled to the brush wand and an upper terminus coupled to the lid thereby providing a space for the fan blade to rotate in an unobstructed manner below the lid.

3. The brush of claim 1, wherein the power supply is rechargeable through a port located on the handle.

4. The brush of claim 1, wherein the handle further comprises a charge indicator configured to display a current charge level of the power supply.

5. The brush of claim 1, further comprising a first light unit having a first light element positioned below the lid and configured to illuminate an area proximate to the brush head.

6. The brush of claim 5, further comprising a lid plate positioned below the lid and configured to secure the first light unit.

7. The brush of claim 5, further comprising a second and a third light element, the first, second, and third light elements arranged below the lid.

* * * * *